US005443094A

United States Patent [19]

Olson et al.

[11] Patent Number: 5,443,094

[45] Date of Patent: Aug. 22, 1995

[54] CONCENTRATED PRODUCT DILUTION SYSTEM

[75] Inventors: Scott R. Olson, Eagan; Steven E. Pasek, Shoreview, both of Minn.

[73] Assignee: Ecolab Inc., St. Paul, Minn.

[21] Appl. No.: 398,048

[22] Filed: Mar. 2, 1995

Related U.S. Application Data

[63] Continuation of Ser. No. 279,840, Jul. 25, 1994, abandoned, which is a continuation of Ser. No. 74,392, Jun. 10, 1993, abandoned.

[51] Int. Cl.[6] ..... B01F 5/04

[52] U.S. Cl. ..... 137/892; 137/888; 222/82; 222/129.2

[58] Field of Search ..... 137/888, 889, 892, 895; 222/57, 82, 129.2

[56] References Cited

U.S. PATENT DOCUMENTS

| | | | |
|---|---|---|---|
| 1,610,714 | 12/1926 | Smith . | |
| 2,054,136 | 9/1936 | Pfaff et al. . | |
| 2,716,507 | 8/1955 | Graves . | |
| 2,785,830 | 3/1957 | Bauerlein | 222/57 |
| 2,811,389 | 10/1957 | Fischer . | |
| 2,965,268 | 12/1960 | Bauerlein | 137/895 X |
| 2,993,651 | 7/1961 | Packard . | |
| 3,016,916 | 1/1962 | Kraft | 137/889 |
| 3,037,707 | 6/1962 | Ligon . | |
| 3,168,967 | 2/1965 | Giampa . | |
| 3,303,800 | 2/1967 | Young . | |
| 3,367,353 | 2/1968 | Hunter | 222/82 X |
| 3,675,851 | 7/1972 | Merfeld et al. | 239/318 |
| 3,698,644 | 10/1972 | Nystven . | |
| 3,811,618 | 5/1974 | Gartner et al. . | |
| 3,863,843 | 2/1975 | Hechler, IV . | |
| 4,142,681 | 3/1979 | Hechler, IV . | |
| 4,171,710 | 10/1979 | Boynton et al. . | |
| 4,238,074 | 12/1980 | Coons . | |
| 4,247,046 | 1/1981 | Hechler, IV . | |
| 4,254,805 | 3/1981 | Reeder . | |
| 4,349,154 | 9/1982 | Pacht . | |
| 4,368,757 | 1/1983 | Finger . | |
| 4,469,137 | 9/1984 | Cleland . | |
| 4,491,254 | 1/1985 | Amerine . | |
| 4,527,740 | 7/1985 | Gunzel, Jr. et al. . | |
| 4,538,636 | 9/1985 | Cleland | 137/893 X |
| 4,697,610 | 10/1987 | Bricker et al. . | |
| 4,750,645 | 6/1988 | Wilson et al. . | |
| 4,753,370 | 6/1988 | Rudick . | |
| 4,901,923 | 2/1990 | McRoskey et al. . | |
| 4,928,853 | 5/1990 | Isham et al. . | |
| 4,934,567 | 6/1990 | Vahjen et al. . | |
| 4,947,739 | 8/1990 | Owen . | |
| 5,033,649 | 7/1991 | Copeland et al. | 222/132 |
| 5,037,003 | 8/1991 | Bally et al. . | |
| 5,042,523 | 8/1991 | Robertson et al. | 137/271 |
| 5,060,825 | 10/1991 | Palmer et al. . | |
| 5,074,438 | 12/1991 | Ingram . | |

FOREIGN PATENT DOCUMENTS

| | | | |
|---|---|---|---|
| 0179189 | 4/1986 | European Pat. Off. . | |
| 0212100 | 3/1987 | European Pat. Off. . | |
| 0325335 | 7/1989 | European Pat. Off. . | |
| 15889 | 10/1912 | France | 137/889 |
| 1139021 | 6/1957 | France . | |
| WO85/05092 | 11/1985 | France . | |
| 2150427 | 8/1973 | Germany . | |
| 55-075735 | 6/1980 | Japan . | |
| 780202 | 7/1957 | United Kingdom . | |
| 2010105 | 6/1979 | United Kingdom . | |
| US89/01316 | 10/1989 | WIPO . | |

OTHER PUBLICATIONS

Hydro Systems Company; New Product Development: Multiple Product Selector Valve; (no publication date).

(List continued on next page.)

*Primary Examiner*—Robert G. Nilson

*Attorney, Agent, or Firm*—Merchant, Gould, Smith, Edell, Welter & Schmidt

[57] ABSTRACT

A product dilution system constructed according to the present invention includes an aspirator wherein a product delivery means allows a product concentrate to flow into the aspirator, and is sized in combination with the size of an outlet orifice of the aspirator to achieve a predetermined dilution ratio. A product package includes an inner flexible receptacle which collapses during product dilution to allow complete evacuation of the product concentrate from the product package.

11 Claims, 1 Drawing Sheet

OTHER PUBLICATIONS

Hydro Systems Company; New Product Development: Variable Dilution Selector Valve; (no publication date).

Hydro Systems Company; New Product Development: HydroFoamer Series; Copyright 1988.

Hydro Systems Company; HydroSprayer Series; Copyright 1989. undated.

Copy of International Search Report for International Appliction No. PCT/US92/03337. undated.

Exhibit A, Economic Laboratory, Inc., Control Tower II advertising brochure No. 13554/0402/0783. undated.

Exhibit B, Dema Engineering Company's Blend Center brochure, Bulletin No. 87003. undated.

Exhibit C, Dema Engineering Company's Multi-Blend Center brochure, Bulletin No. 89010. undated.

Exhibit D, Dema Engineering Company's Drum--Mount Proportioner Model 162 brochure, Bulletin No. 84002. undated.

Exhibit E, Dema Engineering Company's Demamtic Liquid Level Proportioning Controls brochure, Bulletin No. 83009. undated.

Exhibit F, Dema Engineering Company's New Magnetically Operated Demamatic Liquid Level Proportioning Controls brochure, Bulletin No. 87-012. undated.

Exhibit G, Ecolab Sani-Center Installation and Operation Manual. undated.

Exhibit H. Ecolab Inc. "Cleaning Help Available" brochure, Jun. 1991.

CONCENTRATED PRODUCT DILUTION SYSTEM

This is a continuation of application Ser. No. 08/279,840, filed Jul. 25, 1994, now abandoned, which in turn is a continuation of Ser. No. 08/074,392, now abandoned, filed Jun. 10, 1993.

SCOPE OF THE INVENTION

The invention relates to a system for automatically diluting a concentrated product and delivering a diluted concentrated product to a mixing chamber or storage container.

BACKGROUND OF THE INVENTION

The invention is a closed system for safely and automatically delivering a diluted product concentrate to a mixing container. Dilution systems are widely known and used to dilute concentrated products to useable or use concentrations. One common form of a chemical dilution system is an open aspirator dilution system. The use of aspirators to dilute a chemical concentrate is well known. See Cleland U.S. Pat. Nos. 4,538,636 and 4,469,137. The ability to safely dilute a chemical concentrate has been the focus of many of these prior dilution systems.

A number of problems have long plagued these dilution systems. The transportation of undiluted or concentrated chemicals to the users of chemicals is less expensive than transporting the diluted use solution. However, the use of concentrate has been to some degree avoided due to problems in preparing the use solution. Accurately metering the amount of such chemicals, in particular viscous concentrates, and diluent used is difficult to control. Many commercial dilutions systems either avoid the use of higher concentrated material and viscous chemicals or suffer from the effects of producing inconsistent poorly controllable concentrations of use chemicals.

Several problems relate to the use of pumps in dilution apparatus. Many chemical concentrates corrode the pumps resulting in product contamination, poor metering and eventual failure. Further, any failure to prime the pump before beginning chemical delivery results in the delivery of an improper amount of chemical and improper dilution during the initial operation of the pump.

These aspirating dilution systems are also open systems which can introduce concentrated product vapor into the working environment. The vapor can pose health and environmental risks to the operator. These current methods of diluting a concentrated product require pouring the concentrate from a rigid container into a larger rigid plastic drum. These processes are messy, waste product and also require further mechanical mixing to ensure a uniform concentration throughout. A substantial need exists for a closed system that can delivery a consistently diluted use solution to a use site with no need for mechanical or electrical pumping.

SUMMARY OF THE INVENTION

The invention is directed to an apparatus and method which utilizes a closed system for diluting a product concentrate. The apparatus involves an aspirator for moving concentrate for mixing with a diluent stream. The aspirator comprises a product concentrate inlet, a diluent inlet, a venturi and an outlet orifice. A tubular product delivery means is connected in fluid communication to the product concentrate inlet of the aspirator. In order to achieve a predetermined dilution ratio of the product concentrate, the product delivery means comprises a minimum interior diameter sized in combination with the interior diameter or size of the outlet orifice of the aspirator. The inner diameters of these two openings determine the final concentration of the product concentrate that is delivered to a mixing container. The product delivery means is connected to an opening of a product package. This product delivery means does not contain a removable metering means. The dilution system is sized and adapted for the concentrate supplied in the concentrate container and the diluent. The components are not modified or changed to change chemicals or dilution ratios. The dilution systems are sized for specific materials and dilution ratios.

Within the context of the present invention, a metering means is such a meter disclosed in Robertson et al., U.S. Pat. No. 5,042,523. These metering means are changeable within the context of the patented invention, and the present invention does not utilize such metering means to prepare the diluted product.

The product package has a flexible inner receptacle which contains the product concentrate and an outlet port that can direct the product concentrate to the aspirator. The product package and the aspirator are positioned such that the product concentrate will substantially completely drain by gravity flow from the product package to the aspirator or use solution storage. The product package is not vented, but collapses smoothly, during product concentrate removal from the product package.

Finally, a mixing container or use product storage container is connected to the outlet orifice of the aspirator. The mixing container collects the diluent and product concentrate according to the predetermined dilution ratio and stores the diluted product for later use. The mixing container is vented to allow air to escape when the mixing container is filled with the diluted product.

To dilute a product concentrate using the apparatus of the present invention, a diluent is delivered from a diluent source to an aspirator. Additionally, the product concentrate is delivered to the aspirator from a product package without using a pump. The pressure of service water passing through the venturi of the aspirator draws chemical concentration into the service water stream. Within the aspirator, the product concentrate is combined with the service water diluent in a predetermined dilution ratio by using a product delivery means which is sized in combination with the size of an outlet orifice of the aspirator. The difference in size of the inner diameters of these two openings determines the dilution ratio. The packaging dilution system of the present invention is designed as a closed system, where the product concentrate is delivered to the aspirator in a closed environment. Preferably, this is achieved by the use of a pierceable seal on the product package which works in combination with a coupler on the product delivery means.

The flexible inner receptacle allows complete product evacuation during the dilution process. Preferably, the flexible inner receptacle is made from flexible thermoplastic resin materials or rubber. More preferably, the thermoplastic or rubber flexible inner receptacle can successfully store the product concentrate for periods of time in excess of one year without leaking or degrading.

Preferably, the aspirator can be connected to the product delivery means by a quick connect/disconnect coupler. Additionally, the aspirator can be connected to the mixing container by means of a custom molded filling port that incorporates a dip tube designed to reduce product foaming during mixing. Preferably, the dilution apparatus incorporates a back flow preventor to prevent product concentrate contamination after operation of the dilution process ends.

An advantage of the present invention is its closed system design which improves customer safety by minimizing the potential for product exposure. Additionally, the dilution system of the present invention is simpler and safer to use than conventional 15 gallon drum packaging. The present invention has a 90% reduction in weight which reduces the potential for injury and saves money in the distribution and storage of the products.

DETAILED DESCRIPTION

Product Package

Figure 1:
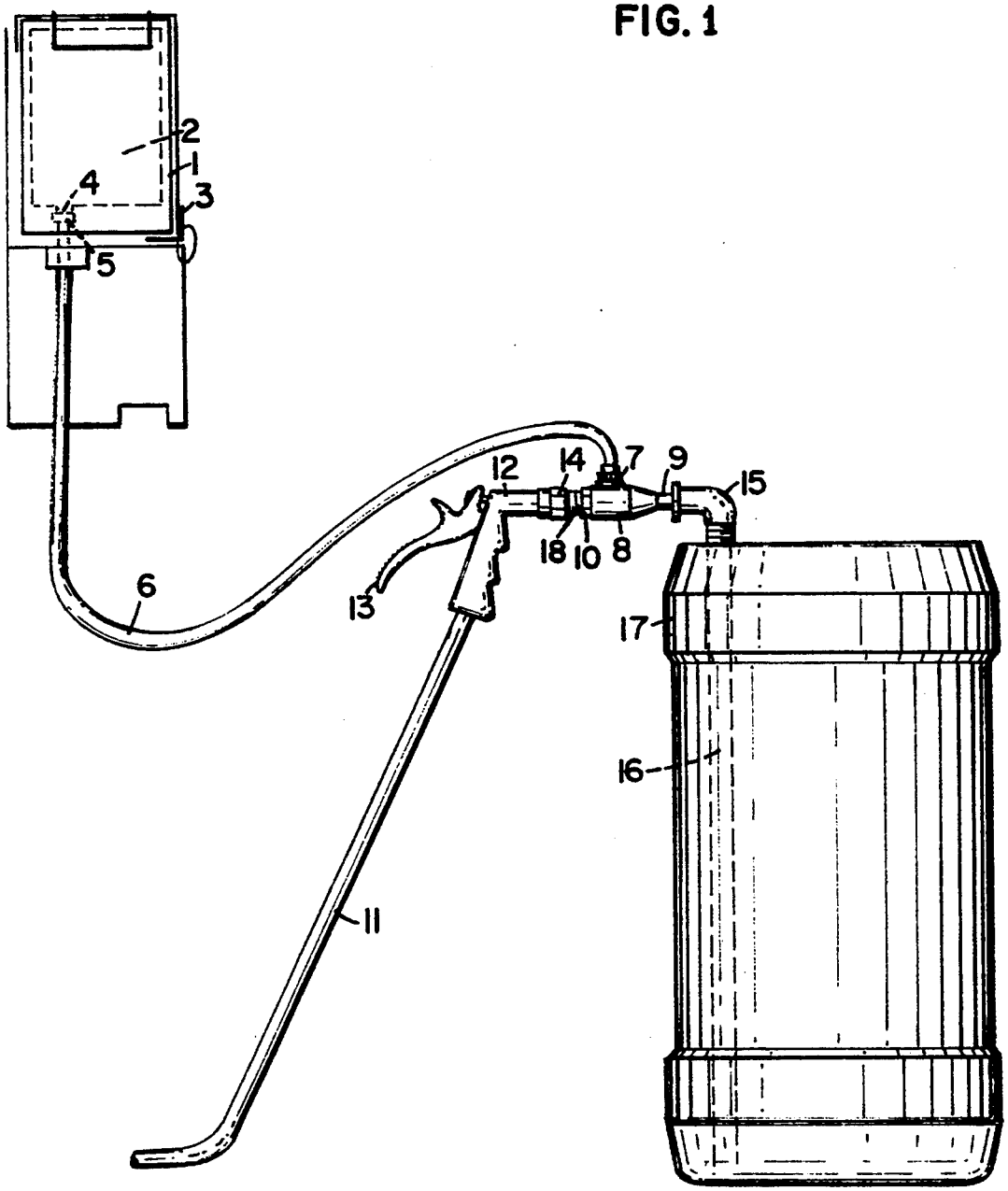
FIG. 1 shows a prospective view of a preferred embodiment of the dilution system.

A product package of the present invention contains an inner flexible receptacle within an outer rigid container. Preferably the outer rigid container maintains its structural integrity during the product concentrate storage and dilution. More preferably, the outer rigid container comprises a corrugated paper material. Preferably the full product package holds about 0.5 to 5.0 gallons of product concentrate. More preferably the full product package holds about 0.75 to 1.25 gallons of product concentrate. Preferably the product has a rectangular shape. More preferably the product package has a cubical structure.

The inner flexible receptacle is a bag or bladder that is not vented. The inner flexible receptacle holds the product concentrate, and allows substantially complete product concentrate removal during the dilution process by collapsing during product concentrate evacuation. Preferably the inner flexible receptacle comprises a flexible thermoplastic or rubber material which is chemically inert to the product concentrate.

The inner flexible receptacle generally incorporates a mechanically attached opening designed to receive a puncture seal fitment. The fitment simultaneously penetrates the seal closure in the receptacle and seals the receptacle to the delivery means. Preferably the puncture seal fitment snaps-in to the mechanically attached opening. The puncture seal fitment is connected to a product delivery means. Preferably the puncture seal fitment is connected to the product delivery means by a quick connect/disconnect coupler. This allows an operator to connect the product package to the product delivery means with one hand and puncture the seal to obtain product flow without a spill or leak.

The product package is positioned in such a manner with respect to the aspirator to allow gravity flow to substantially drain the product concentrate from the product package. Preferably, the product package is mounted on a dispensing rack. The dispensing rack can be made from any rigid material. Preferably, the dispensing rack is manufactured from wire or plastic. The product package rests on or is affixed to the dispensing rack and can be easily removed from the dispensing rack once the product package is emptied.

Preferably, the dispensing rack is attached to the mixing container. More preferably the dispensing rack is bolted to a wall.

Product Delivery Means

The product delivery means is in fluid communication between the product package and a product concentrate inlet of an aspirator. The product concentrate flows from the product package through the product delivery means to the product concentrate inlet of the aspirator. The product concentrate is delivered to the aspirator by gravity flow and without a mechanical or electrical pump boost.

The product delivery means is typically a flexible tube of sufficient rigidity to maintain its cylindric shape during the aspirating process. Preferably the product delivery means is a flexible tube made from a polyurethane. Preferably the polyurethane is a polyether based polyurethane. The product delivery means preferably has a length less than about 4.5 feet. More preferably the product delivery means has a length less than about 4 feet.

The size of the inner diameter of the product delivery means is an important parameter in the dilution process. Preferably the inner diameter is about 0.25 to 0.50 in. More preferably the inner diameter is about 0.312 to 0.438 in. The inner diameter of the product delivery means is selected in combination with the inner diameter of an outlet orifice of the aspirator. The outlet orifice and the inlet to the aspirator are common connection means and do not contain separate metering means. By adjusting the ratio between the inner diameters of the product delivery means and the outlet orifice of the aspirator, a predetermined dilution ratio can be achieved.

Importantly, there is no metering means, as shown in Robertson et al., U.S. Pat. No. 5,042,523, utilized to control the dilution ratio of the product concentrate.

Diluent Source

A diluent source is in fluid communication with diluent inlet of the aspirator. Generally, the diluent source is a service water source of typical flow and pressure found in conventional water lines. Preferably, the diluent source is in fluid communication with a valve means.

The valve means allows the diluent flow to be controlled. In a preferred embodiment the valve means is a gun valve and the diluent source is in fluid communication with a diluent inlet of the diluent gun valve. Additionally, a diluent outlet of the gun valve is in fluid communication with the diluent inlet of the aspirator. Thus, an operator can control the amount of diluent entering the aspirator by the diluent gun valve.

Aspirator

The aspirator comprises the product concentrate inlet, the diluent inlet, a venturi and the outlet orifice. Preferably, the diluent inlet and the outlet orifice are coaxial, and the product concentrate inlet is normal to the axis including the diluent inlet and the outlet orifice.

Aspiration is achieved when diluent flows from the diluent source through the aspirator and out the outlet orifice of the aspirator. A partial vacuum is created by the venturi in the product delivery means, during the aspiration, which causes product concentrate to flow from the product package into the aspirator.

The amount of product concentrate which is drawn in to the aspirator per unit of diluent i.e., "the predetermined dilution ratio" is dependent on the inner diameter of the product delivery means and the inner diameter of the outlet orifice.

Preferably the inner diameter of the outlet orifice is about 0.1 to 0.15 in. More preferably the inner diameter of the outlet orifice is about 0.12 to 0.13 in. The table below gives an illustrative list of different dilution ratios and the corresponding inner diameters of the product delivery means and outlet orifice necessary to achieve these predetermined dilution ratios.

| Dilution Ratio of Concentrated Product to Diluent | | |
|---|---|---|
| Product Delivery Means | Outlet Orifice of the Aspirator Inner Diameter (in.) | |
| Inner Diameter (in.) | .125 | .150 |
| $\frac{3}{8}$ | 1:14 | 1:19 |
| $\frac{1}{4}$ | 1:28 | 1:42 |

In a preferred embodiment, a backflow preventor is utilized to prevent product concentrate contamination. The backflow preventor is in fluid communication with the diluent outlet of the gun valve and the diluent inlet of the aspirator.

In a preferred embodiment the product delivery means is joined to the product concentrate inlet of the aspirator by a quick connect/disconnect coupler. The quick connect/disconnect coupler will allow the operator to make the connection between the product delivery means and the product concentrate inlet with one hand.

Mixing Container

In a preferred embodiment the outlet orifice of the aspirator is in fluid communication with a mixing container. The mixing container can be any vessel which does not react with the diluted product and can store the diluted product. In a typical embodiment the mixing container is a thermoplastic 15 gal. drum.

Preferably the mixing container is filled with dilute product using a filling port in fluid communication to a dip tube. The dip tube extends down into the mixing container and stops a few inches from the bottom of the mixing container. The use of the dip tube will reduce the level of foaming during the dilution process, and increase the amount of mixing between the product concentrate and the diluent.

In a preferred embodiment of the present invention the entire dilution system is portable. The dilution system can be easily moved to wherever the utilization point of the diluted product concentrate.

Method of Dilution

The present invention is also directed to a method of diluting a product concentrate. The method involves delivering a product concentrate from a product package to an aspirator without using a pump, delivering a diluent from a diluent source to the aspirator and diluting the product concentrate to a predetermined dilution ratio by selecting a product delivery means which is sized in combination with the size of an outlet orifice of the aspirator. Additionally, the product delivery means does not contain a metering means.

Product Package

The product package of the present method contains an inner flexible receptacle within an outer rigid container. Preferably the outer rigid container maintains its structural integrity during the product concentrate storage and dilution. More preferably, the outer rigid container comprises a corrugated paper material.

The inner flexible receptacle is a bag or bladder that is not vented. The inner flexible receptacle holds the product concentrate, and allows complete product concentrate removal during the dilution process by collapsing during product concentrate evacuation. Preferably the inner flexible receptacle comprises a flexible material which is chemically inert to the product concentrate.

The inner flexible receptacle generally incorporates a mechanically attached opening designed to receive a puncture seal fitment. The fitment simultaneously penetrates the seal closure in the receptacle and seals the receptacle to the delivery means. Preferably the puncture seal fitment snaps-in to the mechanically attached opening. The puncture seal fitment is connected to a product delivery means. Preferably the puncture seal fitment is connected to the product delivery means by a quick connect/disconnect coupler. This allows an operator to connect the product package to the product delivery means with one hand.

The product package is positioned in such a manner with respect to the aspirator to allow gravity flow to substantially drain the product concentrate from the product package. Preferably, the product package is mounted on a dispensing rack. The dispensing rack can be made from any rigid material. Preferably, the dispensing rack is manufactured from wire or plastic. The product package sets in or is affixed to the dispensing rack and can be easily removed from the dispensing rack once the product package is emptied.

Preferably, the dispensing rack is attached to the mixing container. More preferably the dispensing rack is bolted to a wall.

Product Delivery Means

The product delivery means is in fluid communication between the product package and a product concentrate inlet of an aspirator. The product concentrate is delivered from the product package through the product delivery means to the product concentrate inlet of the aspirator. The product concentrate is delivered to the aspirator by gravity flow and without mechanical or electrical pump boost.

The product delivery means is typically a flexible tube of sufficient rigidity to maintain its cylindric shape during the aspirating process. Preferably the product delivery means is a flexible tube made from a polyurethane. More preferably, the polyurethane is an ether based polyurethane. Preferably the product delivery means has a length less than about 4.5 feet. More preferably the product delivery means is less than about 4 feet long.

The size of the inner diameter of the product delivery means is an important parameter in the dilution process. Preferably the inner diameter is about 0.25 to 0.50 in. More preferably the inner diameter is about 0.312 to 0.438 in. The inner diameter of the product delivery means is selected in combination with the inner diameter of an outlet orifice of the aspirator. The outlet orifice and the inlet to the aspirator are common communication means and do not contain separate metering means. By adjusting the ratio between the inner diameters of the product delivery means and the outlet orifice of the aspirator, a predetermined dilution ratio can be achieved without the use of a metering means as shown in, Robertson et al., U.S. Pat. No. 5,042,523.

Diluent Source

A diluent is delivered to the aspirator from a diluent source which is in fluid communication with diluent inlet of the aspirator. Generally, the diluent source is a service water source of typical flow and pressure found in conventional water lines. Preferably, the diluent source is in fluid communication with a diluent valve means.

The diluent valve means allows the diluent delivery to be controlled. In a preferred embodiment the diluent source is in fluid communication with a diluent inlet of the diluent valve means. Additionally, a diluent outlet of the valve means is in fluid communication with the diluent inlet of the aspirator. Thus, an operator can control the amount of diluent entering the aspirator by the diluent valve means.

Aspirator

The aspirator comprises the product concentrate inlet, the diluent inlet, a venturi and the outlet orifice. Preferably, the diluent inlet and the outlet orifice are coaxial, and the product concentrate inlet is normal to the axis including the diluent inlet and the outlet orifice.

Aspiration is achieved when diluent flows from the diluent source through the aspirator and out the outlet orifice of the aspirator. A partial vacuum is created by the venturi in the product delivery means, during the aspiration, which causes product concentrate to flow from the product package into the aspirator.

In the aspirator, the product concentrate is diluted with the diluent. The amount of product concentrate which is drawn in to the aspirator per unit of diluent i.e., "the predetermined dilution ratio" is dependent on the inner diameter of the product delivery means and the inner diameter of the outlet orifice.

Preferably the inner diameter of the outlet orifice is about 0.10 to 0.15 in. More preferably the inner diameter of the outlet orifice is about 0.12 to 0.13 in. The table below gives an illustrative list of different dilution ratios and the corresponding inner diameters of the product delivery means and outlet orifice necessary to achieve these predetermined dilution ratios.

| Dilution Ratio of Concentrated Product to Diluent | | |
|---|---|---|
| Product Delivery Means | Outlet Orifice of the Aspirator Inner Diameter (in.) | |
| Inner Diameter (in.) | .125 | .150 |
| $\frac{3}{8}$ | 1:14 | 1:19 |
| $\frac{1}{4}$ | 1:28 | 1:42 |

In a preferred method of dilution, a backflow preventor is utilized to prevent product concentrate contamination. The backflow preventor is in fluid communication with the diluent outlet of the gun valve and the diluent inlet of the aspirator.

In a preferred method of dilution the product delivery means is joined to the product concentrate inlet of the aspirator by a quick connect/disconnect coupler. The quick connect/disconnect coupler will allow the operator to make the connection between the product delivery means and the product concentrate inlet with one hand.

Mixing Container

In a preferred method of dilution the diluted product concentrate is further delivered from the outlet orifice of the aspirator to a mixing container. The mixing container can be any vessel which does not react with the diluted product and can store the diluted product. In a typical dilution the mixing container is a thermoplastic 15 gal. drum.

Preferably the mixing container is filled with the diluted product concentrate using a filling port in fluid communication to a dip tube. The dip tube extends down into the mixing container and stops a few inches from the bottom of the mixing container. The use of the dip tube will reduce the level of foaming during the dilution process, and increase the amount of mixing between the product concentrate and the diluent.

Generally, the product package contains an inner flexible receptacle 2 within an outer rigid container 1. In the preferred embodiment, the product package is mounted on a dispensing rack 3. The inner flexible receptacle 2 incorporates a mechanically attached opening with a puncture seal 4.

The puncture seal fitment 4 is connected to a product delivery means 6 by a quick connect/disconnect coupler 5. The product delivery means 6 is in fluid communication to a product concentrate inlet 7 of an aspirator 8.

The aspirator 8 further comprises a diluent inlet 10 and an outlet orifice 9. In the preferred embodiment, a diluent source 11 is in communication with a diluent gun valve 12, and an outlet 14 of the diluent gun valve 12 is in fluid communication with a backflow preventor 18. The backflow preventor is in further communication with the diluent inlet 10 of the aspirator 8. A "trigger" 13 controls the flow of diluent through the diluent gun valve 12 into the aspirator 8.

The outlet orifice 9 is in fluid communication to a filling port 15 which is in further communication to a dip tube 16. The dip tube 16 extends down into the mixing container 17. The diluted product is stored in the mixing container for future use.

Even though several characteristics and advantages of the invention have been set forth in the foregoing description, together with the details of the structure and function of the invention, the disclosure is illustrative only, and changes may be made in detail, especially in matters of shape, size and arrangement of parts, within principles of the invention, to the full extent indicated by the broad, general meaning of the appended claims.

We claim:

1. A concentrated product dilution system comprising:

(a) an aspirator containing a product concentrate inlet, a diluent inlet, a venturi and an outlet orifice having an interior diameter;

(b) a product delivery means, in fluid communication with the product concentrate inlet, having an interior diameter sized in combination with the size of the interior diameter of the outlet orifice of the aspirator to achieve a predetermined dilution ratio of a product concentrate, coupled to an outlet port of a product package wherein the product delivery means does not contain a metering means;

(c) a product package comprising a flexible inner receptacle and an outlet port wherein the product package is positioned such that the product concentrate drains from the product package substantially completely by gravity flow; and (d) a mixing container in fluid communication with the outlet orifice of the aspirator.

2. The concentrated product dilution system of claim 1 further comprising a backflow preventor in fluid communication with the diluent inlet of the aspirator.

3. The concentrated product dilution system of claim 1 further comprising a dispensing rack wherein the dispensing rack is used to position the product package in said position.

4. The concentrated product dilution system of claim 1 further comprising a filling port in fluid communication in both the outlet orifice of the aspirator and a dip tube which is in fluid communication with the mixing container.

5. The concentrated product dilution system of claim 1 further comprising a diluent gun valve comprising:

(a) a diluent inlet port; and (b) a diluent outlet port;

wherein the diluent inlet port is in fluid communication with a diluent source and the diluent outlet port is in fluid communication with the diluent inlet of the aspirator.

6. The concentrated product dilution system of claim 1 wherein the concentrated product dilution system further comprises a puncture seal fitment between the product concentrate and the product delivery tube.

7. The concentrated product dilution system of claim 1 wherein the product delivery means is a tube with an inner diameter between about 0.25 to 0.50 in. and the outlet orifice of the aspirator has an inner diameter between about 0.10 to 0.15 in.

8. The concentrated product dilution system of claim 1 wherein the product delivery means is a flexible tube made from a polyurethane.

9. The concentrated product dilution system of claim 1 wherein the product delivery means is less than about 4.5 feet in length.

10. The concentrated product dilution system of claim 1 wherein the concentrated product dilution system is portable.

11. A concentrated product dilution system comprising:

(a) an aspirator containing a product concentrate inlet, a diluent inlet and an outlet orifice wherein the outlet orifice has an inner diameter between about 0.10 to 0.15 in.;

(b) a product delivery means less than about 4.5 feet in length having an inner diameter between about 0.25 to 0.50 in., in fluid communication with the product concentrate inlet, coupled to an outlet port of a product package wherein the product delivery means does not contain a metering means;

(c) a product package comprising a flexible inner receptacle and an outlet port wherein the product package is positioned such that the product concentrate drains from the product package substantially completely by gravity flow; and (d) a mixing container in fluid communication with the outlet orifice of the aspirator wherein the product dilution system is a closed system and does not utilize a pump to deliver the product concentrates.

* * * * *